US005388390A

United States Patent [19]

Finkowski et al.

[11] Patent Number: 5,388,390

[45] Date of Patent: Feb. 14, 1995

[54] DOUGH CUTTING AND PACKING APPARATUS

[75] Inventors: James W. Finkowski, Andover; William L. Murphy, Maple Grove; Steven K. Hanson, Shoreview, all of Minn.

[73] Assignee: The Pillsbury Company, Minneapolis, Minn.

[21] Appl. No.: 138,369

[22] Filed: Oct. 15, 1993

[51] Int. Cl.[6] ..... B65B 63/00

[52] U.S. Cl. ..... 53/516; 83/123; 83/284; 53/247; 53/473; 53/516; 425/298; 425/397; 426/128

[58] Field of Search ..... 53/244, 247, 250, 473, 53/513, 514, 516; 83/123, 284; 99/509; 425/145, 298, 305.1, 343, 346, 397; 426/128, 397

[56] References Cited

U.S. PATENT DOCUMENTS

| | | | |
|---|---|---|---|
| 2,453,599 | 11/1948 | Schlegel | 83/284 |
| 3,065,584 | 11/1962 | Coleman . | |
| 3,154,986 | 11/1964 | Reid . | |
| 3,273,300 | 9/1966 | Watrous et al. . | |
| 3,339,335 | 9/1967 | Bowden . | |
| 3,427,783 | 1/1969 | Reid . | |
| 3,458,970 | 8/1969 | Reid et al. | 53/516 |
| 3,933,068 | 1/1976 | Rejsa | 83/168 |
| 4,085,563 | 4/1978 | Egee et al. | 53/59 R |
| 4,506,488 | 3/1985 | Matt et al. | 53/55 |
| 4,722,169 | 2/1988 | DeSantis | 53/494 |
| 5,029,431 | 7/1991 | Weening et al. | 53/437 |
| 5,247,782 | 9/1993 | Rejsa | 53/516 |
| 5,292,238 | 3/1994 | Michalak | 53/516 |

FOREIGN PATENT DOCUMENTS

| | | | |
|---|---|---|---|
| 2232906 | 1/1974 | Germany | 83/284 |

*Primary Examiner*—W. Donald Bray
*Attorney, Agent, or Firm*—Kinney & Lange

[57] ABSTRACT

A dough cutting and packing apparatus for cutting a sheet of dough into dough pieces and transferring the dough pieces to containers. A cutting unit is defined by a plurality of cutting plates having dough retaining openings. The sheet of dough is partially sheeted into the dough retaining openings by an initial compressor roll which is spaced from an upper surface of the cutting plates. A terminal compressor roll contacts the upper surface of the cutting plates, and acts to sheet a remaining portion of the dough sheet into the dough retaining openings to divide the dough sheet into a plurality of dough pieces retained in the openings. The initial compressor roll is driven at a peripheral rate of speed that exceeds an instantaneous liner rate of speed of the cutting unit. The terminal compressor roll is frictionally driven via contact with the cutting plates such that a peripheral rate of speed of the terminal compressor matches the linear rate of speed of the cutting unit. A packing mechanism transfers the dough pieces from the cutting unit to the containers as the containers are moved relative to the packing mechanism by a plurality of flighted augers.

14 Claims, 3 Drawing Sheets

DOUGH CUTTING AND PACKING APPARATUS

BACKGROUND OF THE INVENTION

The invention relates generally to dough cutting and packing devices. In particular, the present invention is a dough cutting and packing device having a dough sheeting and cutting mechanism capable of pressing a dough sheet against a cutting unit, having a plurality of openings, to divide the dough sheet into a plurality of large volume dough pieces.

Devices for cutting a sheet of dough into pieces and packing the dough pieces into containers are generally known. U.S. Pat. No. 3,427,783 to Reid, which is incorporated herein by reference, discloses one such dough cutting and packing apparatus. Improvements to the Reid apparatus are included in U.S. Pat. No. 5,247,782 to Rejsa which is herein incorporated by reference. The Rejsa patent discloses an improved packing mechanism driven by a microprocessor controlled servo motor. In Reid, a retaining and releasing assembly is positioned above a center region of a cutting unit. The retaining and releasing assembly includes a plurality of retaining and releasing heads or tubes which are mounted to the cutting and packing apparatus for reciprocating movement through hex shaped cups or openings in cutting plates of the cutting unit. As the tubes move downward they contact dough pieces retained within the hex-shaped openings in the cutting plates. Vacuum pressure through the tubes allows the tubes to retain the dough pieces as the tubes move through the openings in the cutting plates, thereby removing the dough pieces from the cutting unit. Continued downward movement causes the tubes to enter the open ends of containers positioned beneath the cutting unit. Air expelled from the tubes causes the dough pieces to be deposited in the containers. The length of the tubes are graduated such that the dough pieces are deposited in the bottoms of the containers at the start of the packing operation and near the tops of the containers at the end of the packing operation.

The containers are properly positioned for receiving the dough pieces by a plurality of pairs of laterally extending, horizontally disposed upper and lower flighted augers. Empty containers are delivered to a first end of the flighted augers by a first endless belt conveyor. A second endless belt conveyor removes filled containers from a second end of the flighted augers.

An electric drive motor is coupled to a first gear box which in turn is coupled to a second gear box by a first shaft. The second gear box is coupled to the cutting unit through a first mechanical intermittent drive. The first intermittent drive allows the cutting unit to move in a step-wise manner to position successive cutting plates beneath the retaining and releasing assembly. The drive motor is further coupled to a crank through a third gear box. The crank is connected to the retaining and releasing assembly, and thereby moves the tubes in a reciprocating fashion. The reciprocating movement of the tubes is synchronized with the step-wise movement of the cutting unit so that the cutting unit only moves when the tubes are not extending into or through the openings in the cutting plates.

The cutting unit of the cutting and packing apparatus of Reid is further illustrated in-part in prior art FIG. 1. As discussed above, the cutting unit 100 is formed by a plurality of interconnected cutting plates 102 (only one of which is shown in FIG. 1) having a plurality of hex-shaped cups or openings 103. A sheet of dough 104 is carried by the cutting plates 102 which move through the cutting and packing apparatus in the direction of arrow 106.

A transversely extending roll 108, positioned above the cutting plates 102 presses the dough sheet 104 against the cutting plates 102 to divide the dough sheet 104 into a plurality of dough pieces 110 that are held within the hex-shaped openings 103. The dough sheet 104 is divided (i.e., cut) into dough pieces 110 by the action of the roll 108 which engages edges 112 of the cutting plates 102 which define the hex-shaped openings 103. Rotation of the roll 108 in the direction of arrow 114 is effected by the movement of the dough sheet 104 and cutting plates 102 past the roll 108. Beneath the cutting plates 102 and aligned with the roll 108 is a supporting roll 116 which supports the cutting plates 102 during the cutting operation of the roll 108. Rotation of the supporting roll 116 in the direction of arrow 118 is effected by the movement of the cutting plates 102 past the supporting roll 116.

The use of the roll 108 to press the dough sheet 104 against the cutting plates 102 and to divide the dough sheet 104 into a plurality of dough pieces 110 that are held within the hex-shaped openings 103 has some disadvantages. As can be seen in prior art FIG. 1, the roll 108 creates a dough ridge 120 in the dough sheet 104 ahead of the cutting operation performed by the roll 108. This dough ridge 120 distorts the shape of the dough of the dough sheet 104, causing the formation of misshaped or not optimally shaped dough pieces 110 within the hex-shaped openings 103 which are designed to produce dough pieces for a standard size type 204 container. These dough pieces 110 are typically trapezoidal shaped in cross section and therefore the dough pieces 110 do not completely fill the volume of the hex-shaped cups 103. Theoretically, a fully filled hex-shaped cup 103 can hold an optimally shaped dough piece weighing 62.4 grams. It is desirable for certain markets, particularly for the European market, to produce a hex-shaped opening held dough piece weighing approximately 55.0 grams. However, the prior art cutting unit 110 typically can only produce a hex-shaped opening held dough piece weighing approximately 45.0 grams.

It is evident that there is a continuing need for improved dough cutting and packing devices. In particular, there is a need for a dough cutting and packing apparatus which can produce dough pieces of greater weight than can be produced by prior art dough cutting and packing devices. The dough pieces produced should be of a desired shape so as to be aesthetically pleasing to customers. In addition, the dough cutting and packing apparatus should be capable of producing high weight dough pieces at a high rate of speed.

SUMMARY OF THE INVENTION

The present invention is a dough cutting and packing apparatus. The dough cutting and packing apparatus includes an endless cutting unit having a plurality of cutting plates. The cutting plates have a plurality of dough retaining openings. A dough sheeting and cutting mechanism of the dough cutting and packing apparatus includes an initial compressor roll and a terminal compressor roll. The initial compressor roll is positioned adjacent a first end of the cutting unit and operates to partially sheet the dough of a dough strip into the dough retaining openings of the cutting plates. The terminal compressor roll is positioned subsequent to the initial compressor roll and is spaced from the first end of the cutting unit. The terminal compressor roll sheets a remaining portion of the dough of the dough strip into the cutting plates to divide the dough strip into a plurality of dough pieces that are retained in the dough retaining openings.

The cutting plates extend about a rotatable idler element and a rotatable drive element spaced from the idler element. An intermittent drive mechanism is coupled to the drive element to drive the cutting unit in an accelerating and decelerating motion profile with the dough strip supported on an upper surface of the cutting plates. The initial compressor roll is spaced from the upper surface of the cutting plates, whereas the terminal compressor roll contacts the upper surface of the cutting plates.

The dough sheeting and cutting mechanism further includes drive apparatus which is coupled to the initial compressor roll for rotatably driving the initial roll. The drive apparatus includes a gear reduction mechanism which causes rotation of the initial compressor roll at a peripheral rate of speed that is greater than the instantaneous linear rate of speed of the cutting unit. The terminal compressor roll is rotatably driven at a peripheral rate of speed by way of frictional contact with the upper surface of the cutting plates, such that the peripheral rate of speed of the terminal compressor roll matches the linear rate of speed of the cutting unit. The initial roll could also be driven by a chain drive to the terminal roll, or by a servo motor.

After the dough sheeting and cutting mechanism divides the sheet of dough into dough pieces which are held within the dough retaining openings in the cutting plates, the dough pieces are carried to a packing mechanism. The packing mechanism includes a plurality of retaining and releasing heads. The retaining and releasing heads are moved in a reciprocating fashion relative to the cutting unit. As the retaining and releasing heads move downward (i.e., through the packing stroke), they contact the dough pieces held within the retaining openings in the cutting plates. This causes the dough pieces to adhere to the retaining and releasing heads as the heads move through the openings in the cutting plates. Once the retaining and releasing heads enter the open ends of containers positioned beneath the cutting unit, the retaining and releasing heads discharge and deposit the dough pieces in the containers. Next, the retaining and releasing heads are moved out of the open ends of the containers and back through the openings in the cutting plates.

The containers are moved relative to the packing mechanism by a container positioning mechanism defined by a plurality of pairs of flighted augers such that the containers are intermittently stopped below respective retaining and releasing heads to allow the packing mechanism to transfer dough pieces from the cutting unit to the containers.

This dough cutting and packing apparatus is relatively uncomplicated. By providing the dough cutting and packing apparatus with a dough sheeting and cutting mechanism that incorporates an initial compressor roll and a terminal compressor roll, larger weight dough pieces can be produced than those produced by typical prior art dough cutting and packing devices. By using initial and terminal compressor rolls, dough ridges ahead of the rolls are minimized when compared to prior art devices incorporating a single roll. Minimizing dough ridges in the dough of the dough sheet minimizes any distortion in the dough during the sheeting and cutting process creating a more optimally shaped dough piece that substantially fills the hex-shaped openings in the cutting plates. Since the dough pieces substantially fill the volume of the hex-shaped openings the dough cutting and packing apparatus creates greater weight dough pieces that are aesthetically pleasing to customers. In addition, the dough sheeting and cutting mechanism allows the dough pieces to be formed efficiently and at a high rate of speed.

BRIEF DESCRIPTION OF THE DRAWINGS

FIG. 2 is a perspective view of a dough cutting and packing apparatus incorporating a dough sheeting and cutting mechanism in accordance with the present invent(on.

DETAILED DESCRIPTION OF THE PREFERRED EMBODIMENT

Figure 1:
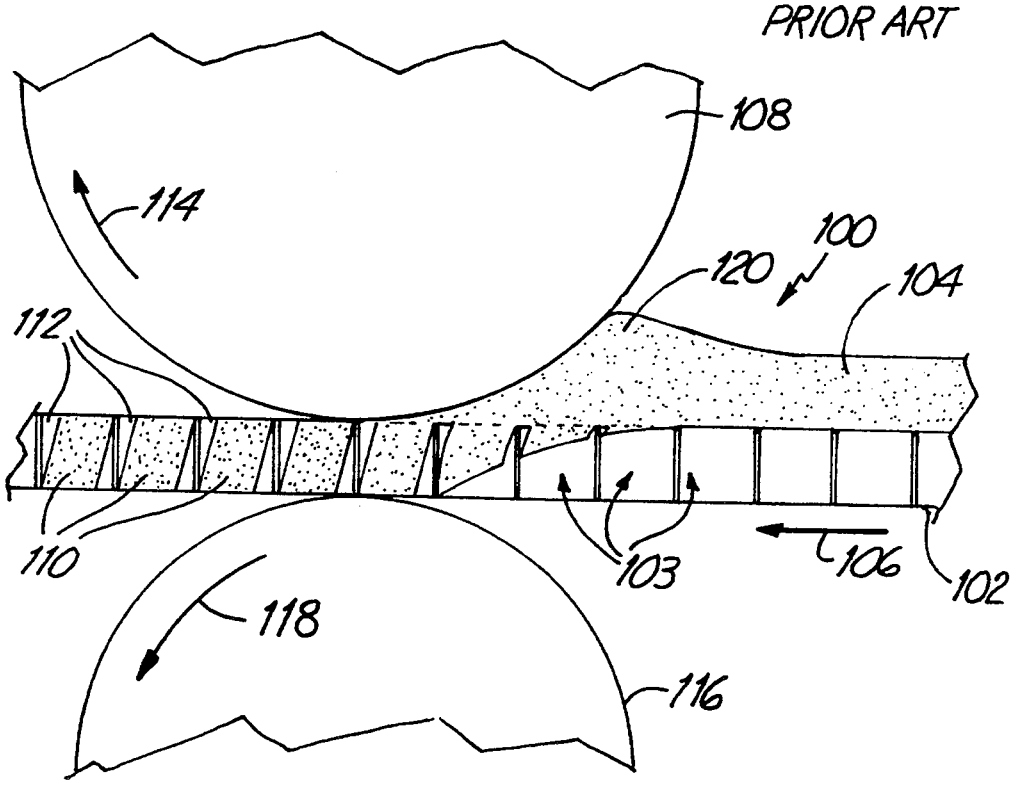
Fig. 1 PRIOR ART
FIG. 1 a side elevational view illustrating the operation of a prior art roll for pressing a dough sheet against a cutting plate, having a plurality of hex-shaped cups, to divide the dough sheet into a plurality of dough pieces that are held within the hex-shaped cups.

A dough cutting and packing apparatus 10 in accordance with the present invention is illustrated generally in FIG. 1. The cutting and packing apparatus 10 includes an endless cutting unit 12 having a plurality of interconnected cutting plates 14 (only some of which are shown in FIG. 1). Each of the cutting plates 14 includes a plurality of dough retaining cups or openings 16. The dough retaining openings 16 are hexagonal in cross section and are typically referred to as hex-shaped. The cutting unit 12 extends about an idler element 18 and a drive element 20. The drive element 20 is coupled to a mechanical intermittent drive 22 which is driven by a first electric drive motor 24 through a gear box (not shown). The intermittent drive 22 causes the cutting unit 12 to be driven in a step-wise manner by the first drive motor 24.

A sheet of dough 26 merges with the cutting unit 12 adjacent the idler element 18. The cutting unit 12 supports the dough sheet 26 as the dough sheet 26 travels through a dough sheeting and cutting mechanism 11. The dough sheeting and cutting mechanism 11 includes an initial compressor roll 13 which is spaced from an upper surface 48 of the cutting plates 14. As seen best in FIG. 3, the initial compressor roll 13 acts to partially sheet (i.e., press) the dough of the dough sheet 26 into the plurality of openings 16 of the cutting plates 14. An initial support roll 15 positioned beneath the cutting plates 14, and in alignment with the initial compressor roll 11, supports the cutting plates 14 as the initial roll 11 sheets the dough sheet 26 into the openings 16. The cutting plates 14 could also be supported from below by a low friction framework or a sliding bed.

The initial roll 13 is rotatably driven by a drive mechanism 17. The drive mechanism 17 includes a gear reduction mechanism 19 having an input sprocket 21 which is coupled to a drive gear 23 fixed to the idler element 18. The input sprocket 21 is coupled to and driven by the drive gear 23 via a first endless drive belt 25. An output sprocket 27 of the gear reduction mechanism 19 is coupled to a driven gear 29 fixed to the initial roll 13. The driven gear 29, and therewith, the initial roll 13 is coupled to and driven by the output sprocket 27 via a second endless drive belt 31. The gear reduction mechanism 19, drive gear 23 and driven gear 29 are set up to rotatably drive the initial roll 13 at a peripheral rate of speed that is greater than a linear rate of speed of the cutting plates 14 of the cutting unit 12 as imparted to the drive and idler elements 20 and 18 via the first electric drive motor 24.

Figure 2:
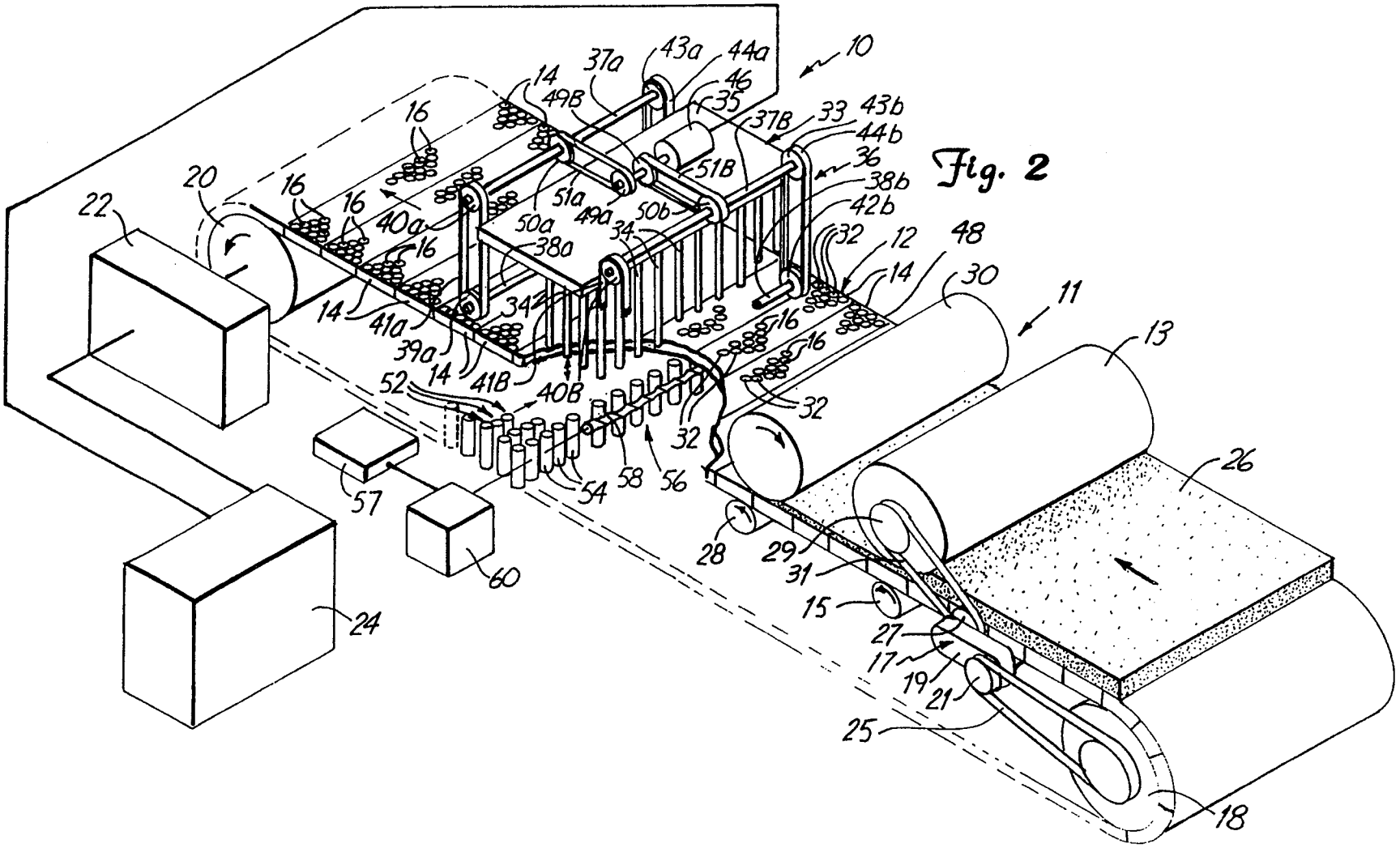
Figure 3:
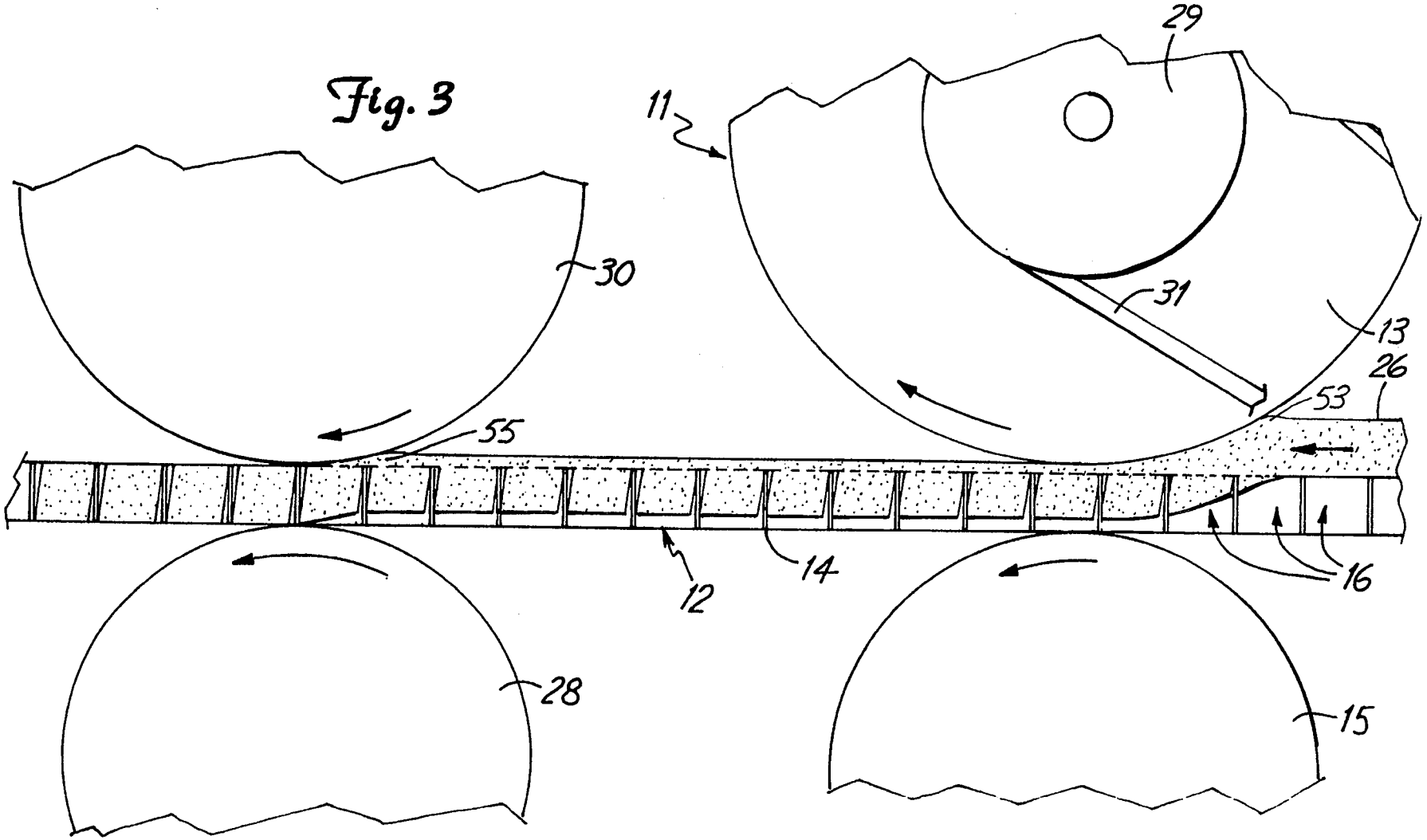
FIG. 3 is a side elevational view illustrating the operation of the dough sheeting and cutting mechanism of the dough cutting and packing apparatus shown in FIG. 2.

As seen in FIGS. 2 and 3, subsequent to the initial roll 13 the dough sheet enters a terminal compressor roll 30 of the dough sheeting and cutting mechanism 11. A support roller 28 positioned beneath the cutting plates 14, supports the cutting plates 14 as a terminal roll 30 presses the remaining dough of the sheet of dough 26 into the cutting plates 14 so that the sheet of dough 26 is finally divided into dough pieces 32 that are held within the retaining openings 16 in the cutting unit 12. The cutting plates 14 could also be supported from below by a low friction framework or a sliding bed. The terminal roll 30 is driven by friction as the sheet of dough 26 passes between the terminal roll 30 and the cutting plates 14. Hence, the peripheral rate of speed of the terminal roll 30 is substantially equal to the linear rate of speed of the cutting plates 14 of the cutting unit 12.

In operation, the initial and terminal rolls 13 and 30 are preferably each approximately thirteen inches in diameter and are preferably formed of a neoprene material. The initial roll 13 is spaced from the upper surface 48 of the cutting plates 14 by a distance of 0.03125 inches to 0.5 inches. Preferably, in operation, the spacing of the initial roll 13 from the upper surface 48 of the cutting plates 14 is 0.125 inches. Typically, the thickness of the dough of the dough sheet 26 before the dough sheet reaches the initial roll 13 is approximately 1.000 to 1.125 inches. Dough sheet thickness is dependent upon the density of the dough of the dough sheet 26. Hence, the initial roll 13 presses between about 0.5 to 1.000 inches of dough into the openings 16 with 0.125 inches of remaining dough of the dough sheet 26 reaching the terminal roll 30.

In operation, the initial roll 13 is driven at a peripheral rate of speed of between 105% and 175% of the linear rate of speed of the cutting unit 12. Preferably, the peripheral rate of speed of the initial roll 13 is 110% of the linear rate of speed of the cutting unit 12. By overdriving the initial roll 13 and spacing the initial roll 13 above the upper surface 48 of the cutting plates 14, the dough of the dough sheet 26 is pushed ahead of the initial roll 13 and sheeted into the openings 26. By forcing the dough of the dough sheet 26 ahead of the initial roll 13 a dough ridge 53 (see FIG. 3) ahead of the initial roll 13 is minimized. In addition, by reducing the amount of dough sheet 26 reaching the terminal roll 30, a dough ridge 55 ahead of the terminal roll 30 is minimized. Minimizing the dough ridges 53 and 55 in the dough of the dough sheet 26 minimizes any distortion in the dough during the sheeting and cutting process creating a more optimally shaped dough piece 32 that substantially fills the openings 16 in the cutting plates 14. Since the dough pieces 32 substantially fill the volume of the openings 16, the dough cutting and packing apparatus 10 creates greater weight dough pieces 32. These dough pieces typically weigh approximately 55.0 grams when cut from a hex bar for a 204 size container.

The dough pieces 32 are carried by the cutting unit 12 away from the terminal roll 30 to a position beneath a packing mechanism 33. As seen best in FIG. 2, the packing mechanism 33 includes a plurality of retaining and releasing heads or tubes 34 rigidly mounted to a support plate 35. The support plate 35 is driven in a reciprocating fashion by a packing mechanism drive assembly 36. The drive assembly 36 includes first and second, upper, rotatable support shafts **37*a* and 37*b*, respectively, and first and second, lower, rotatable support shafts 38*a* and 38*b***, respectively.

As seen in FIG. 2, the first, lower support shaft **38*a* includes a rigidly fixed first idler gear 39*a* and the first, upper shaft 37*a* includes a rigidly fixed first drive gear 40*a*. A first toothed belt 41*a* couples the first idler gear 39*a* to the first drive gear 40*a*. In addition, the first, lower shaft 38*a* includes a rigidly fixed second idler gear (not shown) and the first, upper shaft 37*a* includes a rigidly fixed second drive gear 43*a*. A second toothed belt 44*a* couples the second idler gear 42*a* to the second drive gear 43*a*. The first and second belts 41*a* and 44*a* permit rotation of the first, upper shaft 37*a* to be transferred to the first, lower shaft 38*a*. The support plate 35 is secured to the toothed belts 41*a* and 44*a*** through connectors (not shown).

Like the first, lower shaft **38*a*, the second lower shaft 38*b* includes a rigidly fixed, first idler gear (not shown) and a rigidly fixed second idler gear 42*b*. In addition, like the first, upper shaft 37*a*, the second, upper shaft 37*b* includes rigidly fixed, first and second drive gears 40*b* and 43*b*, respectively. A third toothed belt 41*b* couples the first idler gear to the first drive gear 40*b* and a fourth toothed belt 44*b* couples the second idler gear 42*b* to the second drive gear 43*b*. The third and fourth belts 41*b* and 44*b* permit rotation of the second, upper shaft 37*b* to be transferred to the second, lower shaft 38*b*. The support plate 35 is secured to the toothed belts 41*b* and 44*b*** through connectors (not shown).

As seen best in FIG. 2, the packing mechanism drive assembly 36 further includes an electric servo motor 46. The servo motor 46 includes a rotatable output shaft having rigidly fixed, first and second drive sprockets **49*a* and 49*b*, respectively. The first drive sprocket 49*a* is coupled to an idler sprocket 50*a*, rigidly fixed to the first upper shaft 37*a*, through a fifth toothed belt 51*a*. Likewise, the second drive sprocket 49*b* is coupled to an idler sprocket 50*b*, rigidly fixed to the second upper shaft 37*b*, through a sixth toothed belt 51*b*. The servo motor 46 is coupled to a motion control module such as a programmable microprocessor 57. The programmable microprocessor 57 controls the rate at which the servo motor 46 operates and further controls stopping and starting of the servo motor 46**.

Clockwise rotation (as viewed in FIG. 2) of the drive sprockets **49*a* and 49*b* via servo motor 46 causes downward movement (i.e., a packing stroke) of the retaining and releasing heads 34. Likewise, counter-clockwise rotation (as viewed in FIG. 2) of the drive sprockets 49*a* and 49*b* via servo motor 46 causes upward movement (i.e., a return stroke) of the retaining and releasing heads 34. Reciprocating movement of the retaining and releasing heads 34 through operation of the servo motor 46 causes the heads 34 to pass through the openings 16 in the cutting plates 14. As the retaining and releasing heads 34 move downward (i.e., through the packing stroke), they contact the dough pieces 32 held within the retaining openings 16 in the cutting plates 14 and cause the dough pieces 32 to be deposited in the containers 54 through open ends 52 of the containers 54. In the return stroke of the retaining and releasing heads 34 move out of the open ends 52 of the containers 54 and back through the openings 16 in the cutting plates 14. The container packing mechanism 33** is described in U.S. Pat. No. 5,247,782 to Rejsa, which is hereby incorporated herein by reference thereto.

The length of the heads 34 are graduated such that the dough pieces 32 are deposited in the bottoms of the containers 54 at the start of the packing operation and near the tops of the containers 54 at the end of the packing operation. The reciprocating movement of the retaining and releasing heads 34 is synchronized with the step-wise movement of the cutting unit 12 so that the cutting unit 12 only moves when the heads 34 are not extending into or through the retaining openings 16 in the cutting plates 14.

As seen in FIG. 2, the containers 54 are properly positioned for receiving the dough pieces 32 by a container positioning mechanism 56 defined by a plurality of pairs of laterally extending, horizontally disposed upper and lower flighted augers 58 that engage the containers 54. The container positioning mechanism 56 is positioned beneath the cutting unit 12 and the packing mechanism 33 so that the containers 54 are positioned in aligned registry with retaining and releasing heads 34. Empty containers 54 are delivered to a first end of the flighted augers 58 by a first endless belt conveyor (not shown). A second endless belt conveyor (not shown) removes filled containers 54 from a second end of the flighted augers 58. The flighted augers 58 of the container positioning mechanism 56 are driven by a second electric drive motor 60. The second electric drive motor 60 is coupled to the programmable microprocessor 57. The programmable microprocessor 57 controls the rate at which the second drive motor 60 operates and further controls stopping and starting of the second drive motor 60. The container positioning mechanism 56 is described in U.S. patent application DOUGH CUTTING AND PACKING APPARATUS, Ser. No. 07/776,900, filed on Oct. 16, 1991, which is a Continuation of U.S. patent application DOUGH CUTTING AND PACKING APPARATUS, Ser. No. 07/521,734, filed on May 10, 1990, which are hereby incorporated herein by reference thereto.

The dough cutting and packing apparatus 10 is relatively uncomplicated. By providing the dough cutting and packing apparatus 10 with a dough sheeting and cutting mechanism 11 that incorporates an initial compressor roll 13 and a terminal compressor roll 30, larger weight dough pieces 32 can be produced than those produced by typical prior art dough cutting and packing devices. By using initial and terminal compressor rolls 13 and 30, dough ridges 53 and 55 ahead of the rolls 13 and 30 are minimized when compared to prior art devices incorporating a single roll. Minimizing dough ridges 53 and 55 in the dough of the dough sheet 26 minimizes any distortion in the dough during the sheeting and cutting process creating a more optimally shaped dough piece 32 that substantially fills the hex-shaped openings 16 in the cutting plates 14. Since the dough pieces 32 substantially fill the volume of the hex-shaped openings 16 the dough cutting and packing apparatus 10 creates greater weight dough pieces 32 that are aesthetically pleasing to customers. In addition, the dough sheeting and cutting mechanism 11 allows the dough pieces 32 to be formed efficiently and at a high rate of speed.

Although the present invention has been described with reference to preferred embodiments, workers skilled in the art will recognize that changes may be made in form and detail without departing from the spirit and scope of the invention.

What is claimed is:

1. In a dough cutting and packing apparatus of the type including a movable, endless cutting unit having a plurality of openings for retaining dough pieces, and a packing mechanism positioned above the endless cutting unit and configured to reciprocate through the openings in the cutting unit for removing the dough pieces from the openings, and further including a container positioning mechanism for moving a plurality of containers relative to the packing mechanism such that the containers are advanced from a position aligned with a first set of openings to successive positions aligned with successive sets of openings to allow the packing mechanism to transfer dough pieces from the cutting unit to the containers until the containers are filled, the improvement which comprises:

a dough sheeting and cutting mechanism including:

first means positioned adjacent a first end of the cutting unit for partially sheeting dough of a dough strip into the plurality of openings in the cutting unit; and second means positioned subsequent to the first means and spaced from the first end of the cutting unit for sheeting a remaining portion of dough of the dough strip into the cutting unit to divide the dough strip into the plurality of dough pieces that are retained within the plurality of openings in the cutting unit.

2. The dough cutting and packing apparatus of claim 1 wherein the endless cutting unit includes:

a plurality of interconnected cutting plates that extend about a rotatable idler element and a rotatable drive element spaced from the idler element; and a drive mechanism coupled to the drive element for driving the cutting unit at a linear rate of speed, the dough strip being supported on an upper surface of the cutting plates as the dough strip and cutting plates travel through the dough sheeting and cutting mechanism.

3. The dough cutting and packing apparatus of claim 2 wherein the first means includes an initial rotatable member which is spaced from the upper surface of the cutting plates.

4. The dough cutting and packing apparatus of claim 3 wherein the spacing between the initial rotatable member and the upper surface of the cutting plates is between 0.03125 inches and 0.5 inches.

5. The dough cutting and packing apparatus of claim 3 wherein the initial rotatable member is a cylindrical compressor roll, and wherein the dough sheeting and cutting mechanism further includes drive means coupled to the initial compressor roll for rotatably driving the initial compressor roll.

6. The dough cutting and packing apparatus of claim 5 wherein the drive means includes a gear reduction mechanism which causes rotation of the initial compressor roll at a peripheral rate of speed that is greater than the instantaneous linear rate of speed of the cutting unit.

7. The dough cutting and packing apparatus of claim 6 wherein the peripheral rate of speed is between 105% and 175% of the linear rate of speed.

8. The dough cutting and packing apparatus of claim 6 wherein the drive means further includes a first drive belt coupling the gear reduction mechanism to the initial compressor and a second drive belt for coupling the gear reduction mechanism to the idler element of the cutting unit.

9. The dough cutting and packing apparatus of claim 5 wherein the dough sheeting and cutting mechanism further includes an initial supporting roll positioned adjacent to a lower surface of the cutting plates and in alignment with the initial compressor roll, the initial supporting roll supporting the cutting plates during operation of the initial compressor roll.

10. The dough cutting and packing apparatus of claim 5 wherein the dough sheeting and cutting mechanism includes a low friction framework or a slide bed, positioned adjacent to a lower surface of the cutting plates and in alignment with the initial compressor roll, for supporting the cutting plates during operation of the initial compressor roll.

11. The dough cutting and packing apparatus of claim 5 wherein the second means includes a terminal rotatable member which contacts the upper surface of the cutting plates.

12. The dough cutting and packing apparatus of claim 11 wherein the terminal rotatable member is a terminal rotatable, cylindrical compressor roll, and wherein the terminal compressor roll is rotatably driven at a peripheral rate of speed by way of frictional contact with the upper surface of the cutting plates such that the peripheral rate of speed of the terminal compressor roll matches the linear rate of speed of the cutting unit.

13. The dough cutting and packing apparatus of claim 12 wherein the dough sheeting and cutting mechanism further includes a terminal supporting roll positioned adjacent to a lower surface of the cutting plates and in alignment with the terminal compressor roll, the terminal supporting roll supporting the cutting plates during operation of the terminal compressor roll.

14. The dough cutting and packing apparatus of claim 12 wherein the dough sheeting and cutting mechanism includes a low friction framework or a slide bed, positioned adjacent to a lower surface of the cutting plates and in alignment with the terminal compressor roll, for supporting the cutting plates during operation of the terminal compressor roll.

* * * * *